US007821461B2

(12) United States Patent
Lai et al.

(10) Patent No.: US 7,821,461 B2
(45) Date of Patent: Oct. 26, 2010

(54) ANTENNA

(75) Inventors: Ming-Iu Lai, Taipei (TW); Chun-Hsiung Wang, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 358 days.

(21) Appl. No.: 12/118,612

(22) Filed: May 9, 2008

(65) Prior Publication Data

US 2008/0278381 A1 Nov. 13, 2008

(30) Foreign Application Priority Data

May 10, 2007 (TW) ..... 96116641 A

(51) Int. Cl.
*H01Q 1/38* (2006.01)

(52) U.S. Cl. ..... 343/700 MS; 343/846; 343/829; 343/850; 343/865

(58) Field of Classification Search ..... None
See application file for complete search history.

(56) References Cited

U.S. PATENT DOCUMENTS

| | | | | |
|---|---|---|---|---|
| 4,410,891 | A | 10/1983 | Schaubert et al. | |
| 6,850,192 | B2 * | 2/2005 | Yeh | 343/700 MS |
| 6,917,342 | B2 | 7/2005 | Thudor et al. | |
| 6,970,135 | B2 * | 11/2005 | Sato et al. | 343/702 |
| 7,403,169 | B2 * | 7/2008 | Svensson et al. | 343/767 |
| 7,436,360 | B2 * | 10/2008 | Chen et al. | 343/700 MS |
| 7,443,346 | B2 * | 10/2008 | Shih | 343/700 MS |
| 7,443,350 | B2 * | 10/2008 | Gaucher et al. | 343/702 |
| 7,619,564 | B2 * | 11/2009 | Chang et al. | 343/700 MS |

FOREIGN PATENT DOCUMENTS

KR 2005-0022846 3/2005

OTHER PUBLICATIONS

Carl B. Dietrich et al. "Spatial, Polarization, and Pattern Diversity for Wireless Handheld Terminals", Sep. 2001, pp. 1271-1281, IEEE Transactions of Antennas and Propagation, vol. 49, No. 9, US.
Simon R. Saunders. pp. 323-342, Antenna and Propagation for Wireless Communication System, John Wiley & Sons, Ch. 15, 1999, US.
Nader Behdad et al. "Dual-Ban dReconfigurable Antenna with a Very Wide Tunability Range", Feb. 2006, pp. 409-416, IEEE Transactions of Antennas and Propagation, vol. 54, No. 2, US.

(Continued)

*Primary Examiner*—Trinh V Dinh

(57) ABSTRACT

An antenna includes a base plate, a grounding component, a feed-in conductor, a first controlling unit and a second controlling unit. The base plate includes a first surface and a second surface. The grounding component is provided on the first surface and includes a first part, a second part and a notch formed between the first part and the second part. The feed-in conductor is provided on the second surface and includes a first conducting part. The first conducting part extends across the notch, and is coupled to the first part. The first controlling unit is provided on the second surface and includes a first wire. The first wire extends across the notch, and is coupled to the first part. The second controlling unit is provided on the second surface and includes a second wire. The second wire extends across the notch, and is coupled to the first part.

24 Claims, 7 Drawing Sheets

OTHER PUBLICATIONS

Nader Behad et al. "A Varactor-Tuned Dual-Band Slot Antenna", Feb. 2006, pp. 401-408, IEEE Transactions of Antennas and Propagation, vol. 54, No. 2, US.

Symeon Nikolaou et al. "Pattern and Frequency Reconfigurable Annular Slot Antenna Using PIN Diodes", Feb. 2006, pp. 439-448, IEEE Transactions of Antennas and Propagation, vol. 54, No. 2, US.

Dimitrios Peroulis et al. "Design of Reconfigurable Slot Antennas", Feb. 2005, pp. 645-654, IEEE Transactions of Antennas and Propagation, vol. 53, No. 2, US.

Saeed I. Latif et al. "Bandwidth Enhancement and Size Reduction of Microstrip Slot Antennas", Mar. 2006, pp. 994-1003, IEEE Transactions of Antennas and Propagation, vol. 53, No. 3, US.

Bruce M. Green et al. "Diversity Performance of Dual-Antenna Handsets Near Operator Tissue", Jul. 2000, pp. 1017-1024, IEEE Transactions of Antennas and Propagation, vol. 48, No. 7, US.

* cited by examiner

ANTENNA

BACKGROUND OF THE INVENTION

1. Field of the Invention

The invention relates to an antenna and, more particularly, to an antenna applied to a miniature portable electronic device.

2. Description of the Related Art

In the concept of the digital home, electronic equipment such as a computer, a television, and sound equipment can be connected together via the wireless local area network (WLAN) technology to enable users to store or access various digital content and real-time multimedia data. Nowadays, the highest transmitting speed of WLAN can be more than 100 Mbps, but in an actual living environment, limited by the phenomenon of multipath fading, the conventional WLAN system using a single antenna cannot supply steady data transmitting. Diversity antenna technology can solve this problem effectively, but more than two antennas must be designed if the diversity antenna technology is used to improve the communicating quality, so that the antennas will occupy more space in a wireless communicating product. The diversity antenna technology is not practical for miniature portable equipment.

BRIEF SUMMARY OF THE INVENTION

The invention provides a miniature antenna with an adjustable radiation pattern to solve the problem about the big size of the antenna. The antenna includes a base plate, a grounding component, a feed-in conductor, a first controlling unit and a second controlling unit. The base plate includes a first surface and a second surface. The grounding component is provided on the first surface and includes a first part, a second part and a notch. The notch is formed between the first part and the second part. The feed-in conductor is provided on the second surface and includes a first conducting part. The conducting part extends across the notch, and is coupled to the first part. The first controlling unit is provided on the second surface and includes a first wire. The first wire extends across the notch, and is coupled to the first part. The second controlling unit is provided on the second surface and includes a second wire. The second wire extends across the notch, and is coupled to the first part.

A first working mode and a second working mode can be used and switched by the antenna of the invention to receive wireless signals from different directions, so that a preferred signal transmitting effect can be obtained.

DETAILED DESCRIPTION OF THE EMBODIMENTS

Figure 1:
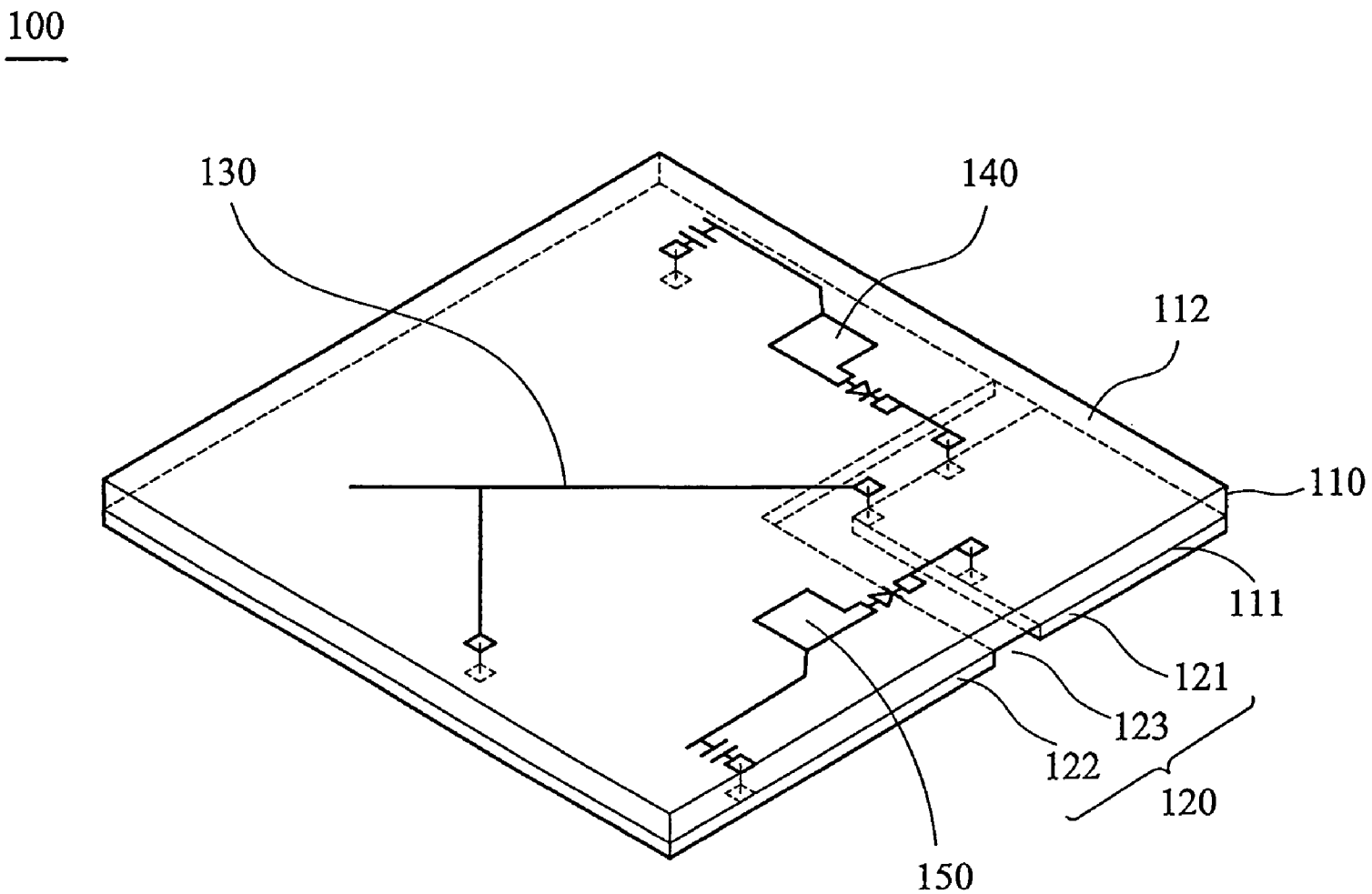
FIG. 1 is a three-dimensional diagram showing an antenna of one embodiment of the invention.

FIG. 1 shows an antenna 100 of one embodiment of the invention, and the antenna 100 includes a base plate 110, a grounding component 120, a feed-in conductor 130, a first controlling unit 140 and a second controlling unit 150. The base plate 110 includes a first surface 111 and a second surface 112. The grounding component 120 is provided on the first surface 111. The feed-in conductor 130, the first controlling unit 140 and the second controlling unit 150 are provided on the second surface 112.

Figure 2:
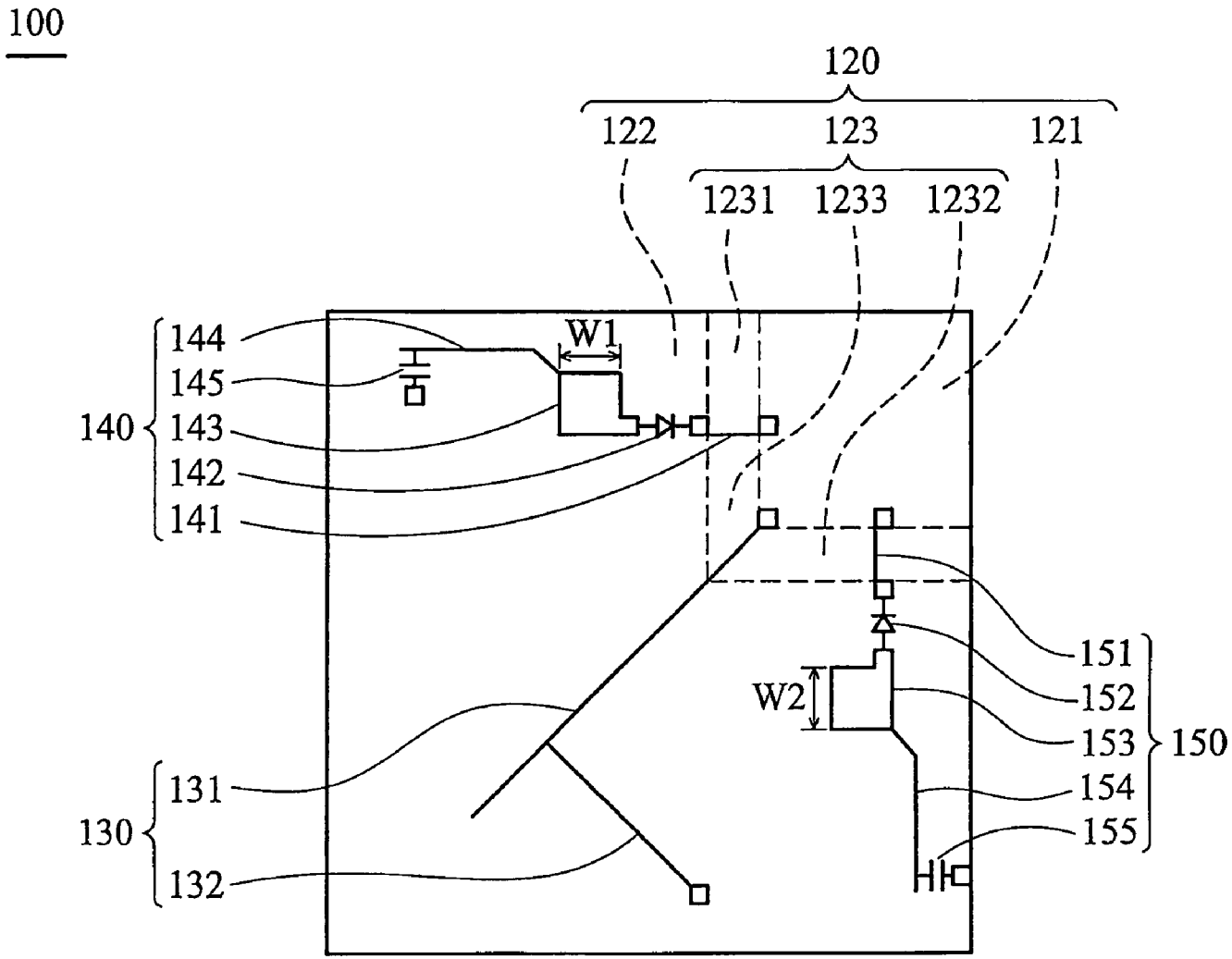
FIG. 2 is a top view showing an antenna of one embodiment of the invention.

Please refer to FIG. 2 simultaneously. The grounding component 120 includes a first part 121, a second part 122 and a notch 123. The notch 123 is L-shaped and formed between the first part 121 and the second part 122. The notch 123 includes a first segment 1231, a second segment 1232 and a corner 1233. The first segment 1231 is perpendicular to the second segment 1232, and the corner 1233 is connected to the first segment 1231 and second segment 1232. The feed-in conductor 130 includes a first conducting part 131 and a second conducting part 132. The first conducting part 131 extends across and corner 1233, passes through the base plate 110, and is coupled to the first part 121. The second conducting part 132 is perpendicular to the first conducting part 131, passes through the base plate 110, and is coupled to the second part 122. The first controlling unit 140 includes a first wire 141, a first diode 142, a first metal sheet 143, a first transmitting wire 144 and a first capacitor 145. The first wire 141 extends across the first segment 1231, passes through the base plate 110, and is coupled to the first part 121. The first diode 142 is coupled to the first wire 141 and the first metal sheet 143. The first transmitting wire 144 is coupled to the first metal sheet 143, and the first capacitor 145 is coupled to the first transmitting wire 144 and the second part 122. The second controlling unit 150 includes a second wire 151, a second diode 152, a second metal sheet 153, a second transmitting wire 154 and a second capacitor 155. The second wire 151 extends across the second segment 1232, passes through the base plate 110, and is coupled to the first part 121. The second diode 152 is coupled to the second wire 151 and the second metal sheet 153. The second transmitting line 154 is coupled to the second metal sheet 153, and the second capacitor 155 is coupled to the second transmitting wire 154 and the second part 122.

Figure 3:
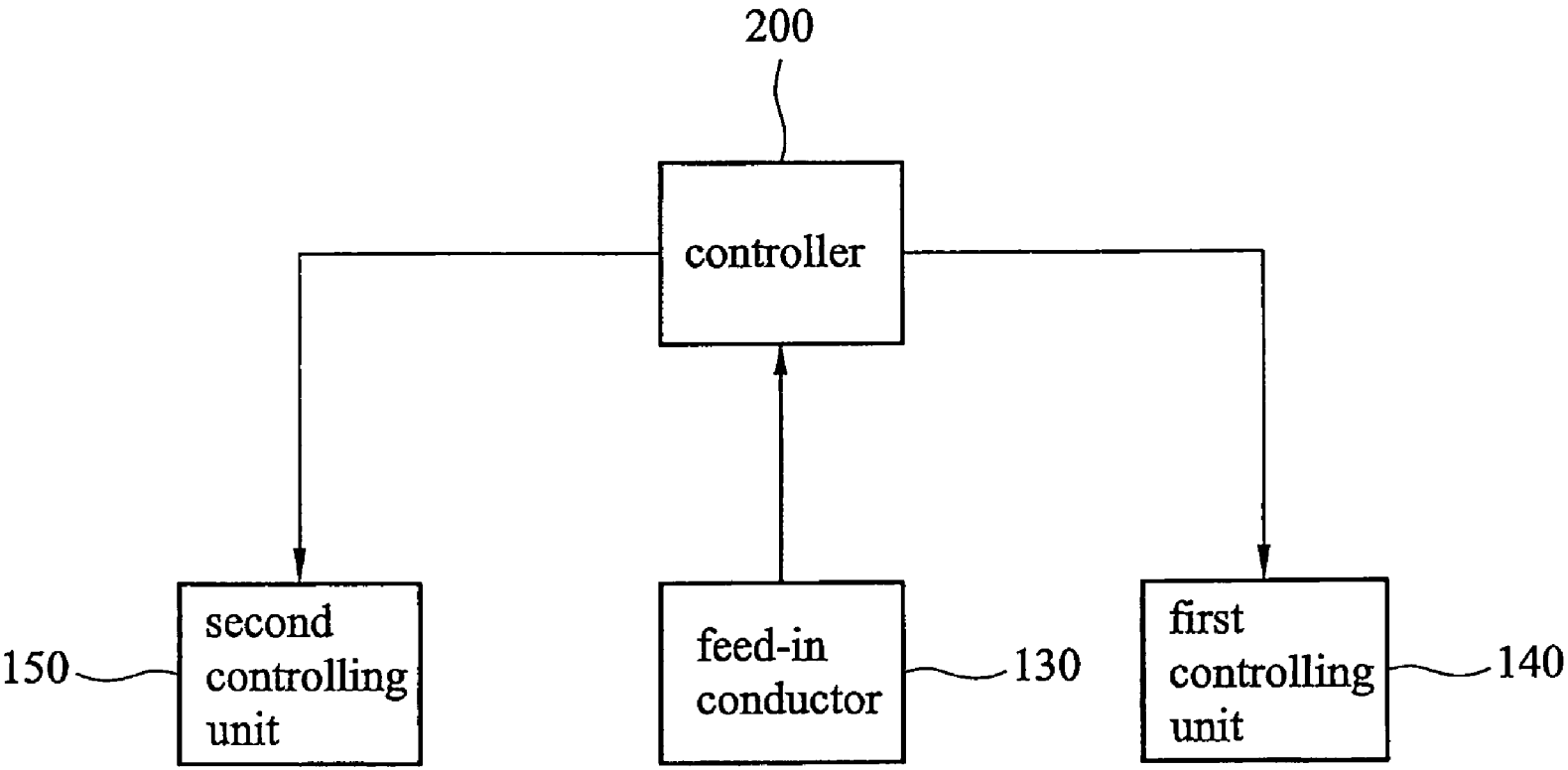
FIG. 3 is a block diagram showing an antenna and a controller of one embodiment of the invention.

Please refer to FIG. 3. The feed-in conductor 130, the first controlling unit 140 and the second controlling unit 150 are coupled to a controller 200. The controller 200 adjusts the first controlling unit 140 and the second controlling unit 150 according to the transmitting effect of the signals fed by the feed-in conductor 130, so that the antenna 100 can transmit signals in a first transmitting mode or in a second transmitting mode.

Figure 4A:
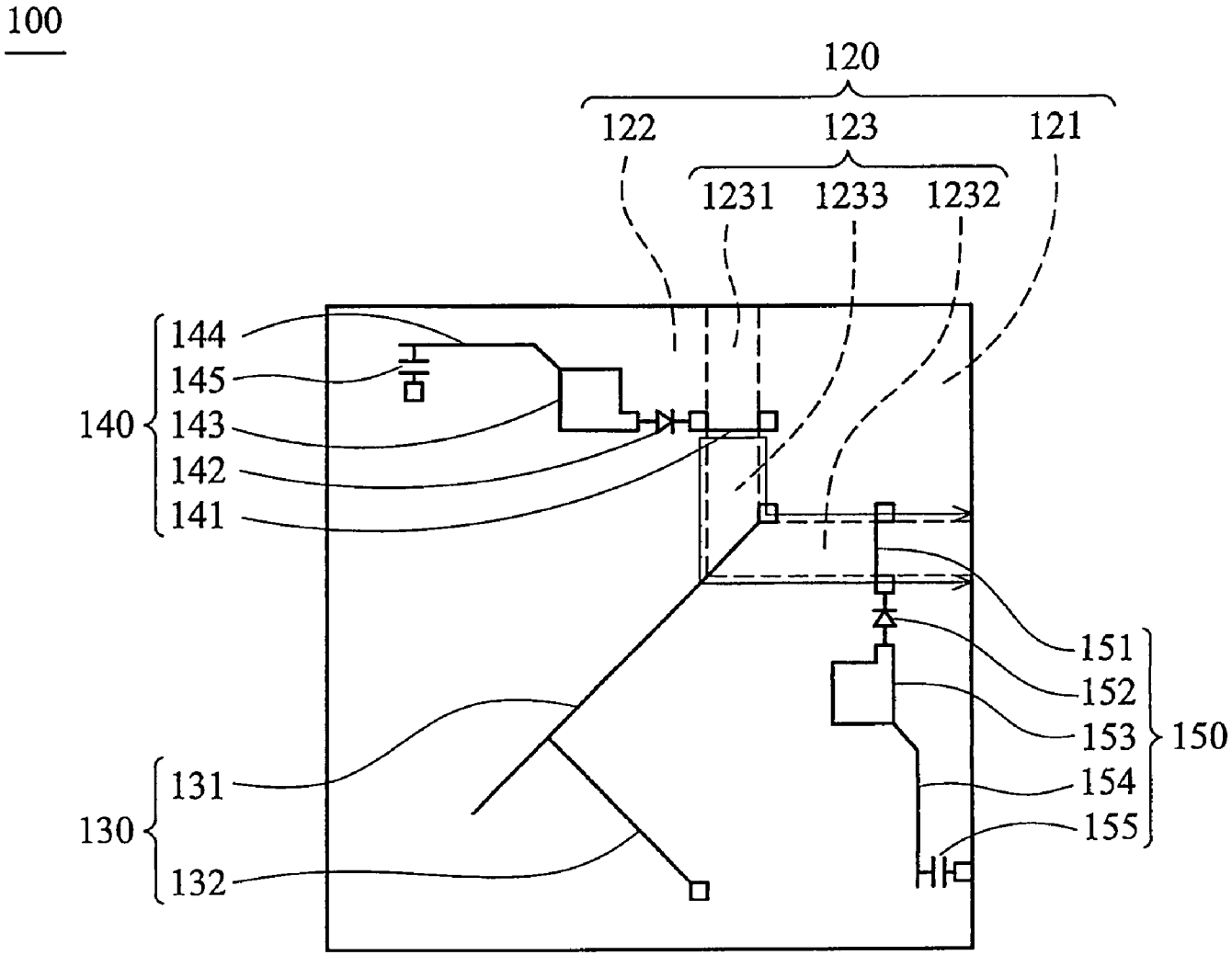
FIG. 4*a* shows the flowing situation of the current in the first working mode.
Figure 4B:
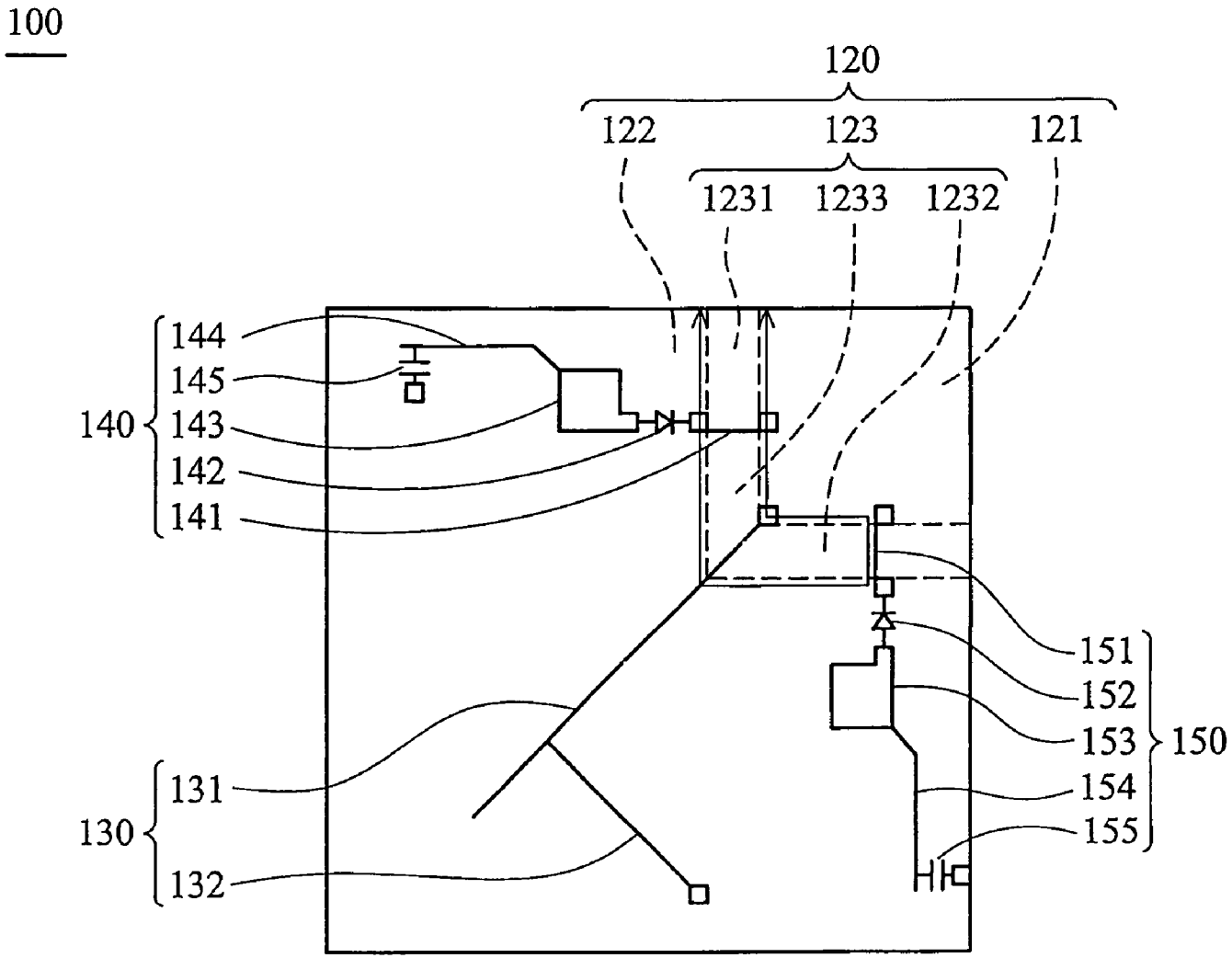
FIG. 4*b* shows the flowing situation of the current in the second working mode.

Please refer to FIG. 4*a*. When the antenna 100 is in the first working mode, the controller 200 applies an external voltage on the first transmitting wire 144, and the first diode 142 conducts. The induced current is shown in FIG. 4*a*. Please refer to FIG. 4*b*. When the antenna 100 is in the second working mode, the controller 200 applies an external voltage on the second transmitting wire 154, and the second diode 152 conducts. The induced current is shown in FIG. 4*b*.

Figure 5A:
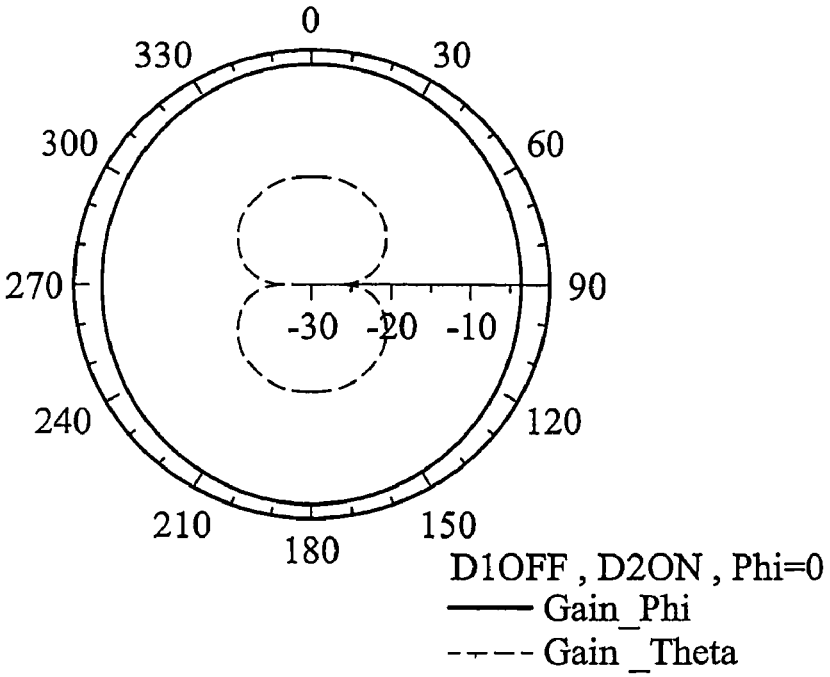
FIG. 5*a* shows the radiation pattern on the $\phi=0°$ tangent plane when the antenna of one embodiment of the invention in the first working mode.
Figure 5B:
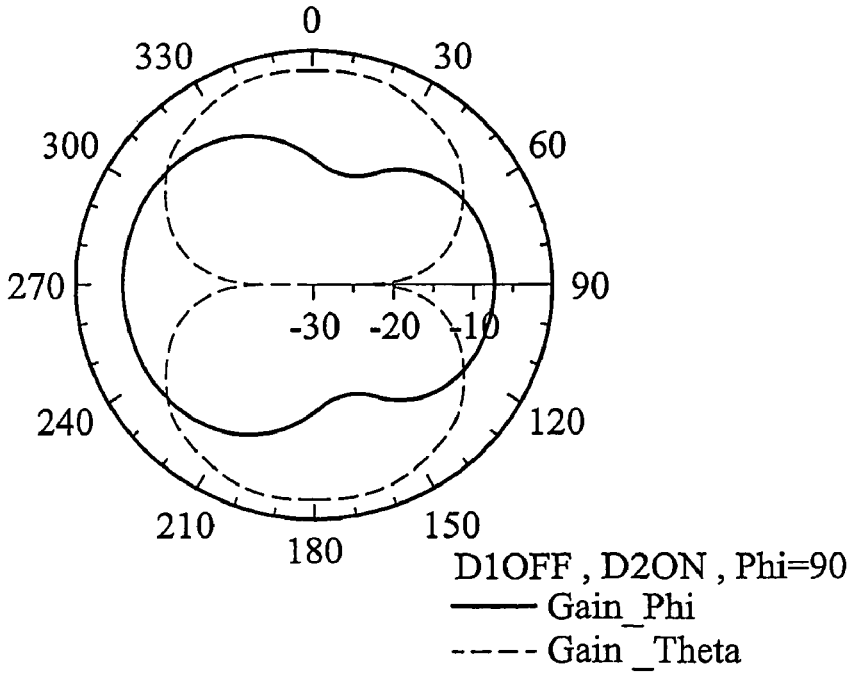
FIG. 5*b* shows the radiation pattern on the $\phi=90°$ tangent plane when the antenna of one embodiment of the invention in the first working mode.
Figure 5C:
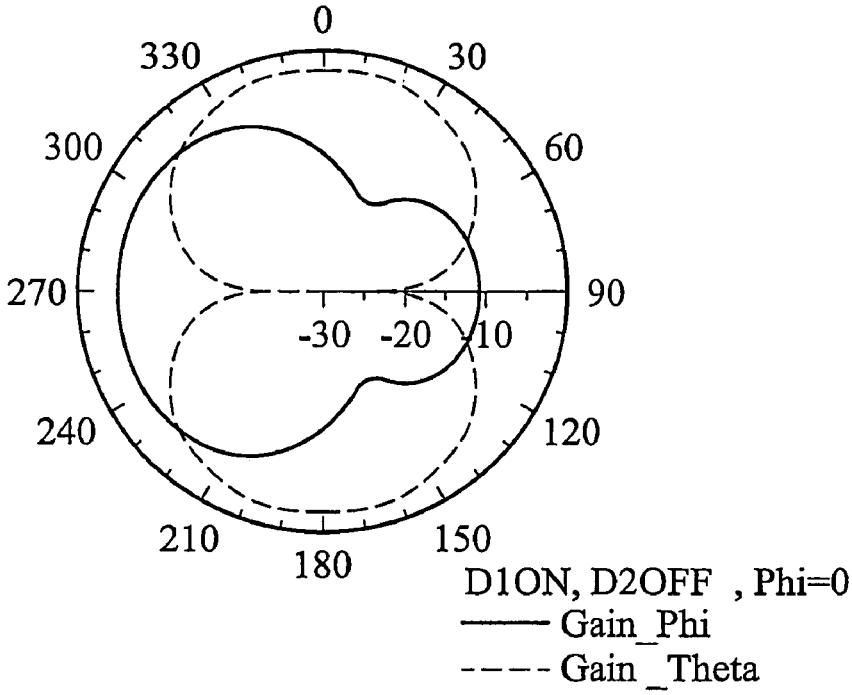
FIG. 5*c* shows the radiation pattern on the $\phi=0°$ tangent plane when the antenna of one embodiment of the invention in the second working mode.
Figure 5D:
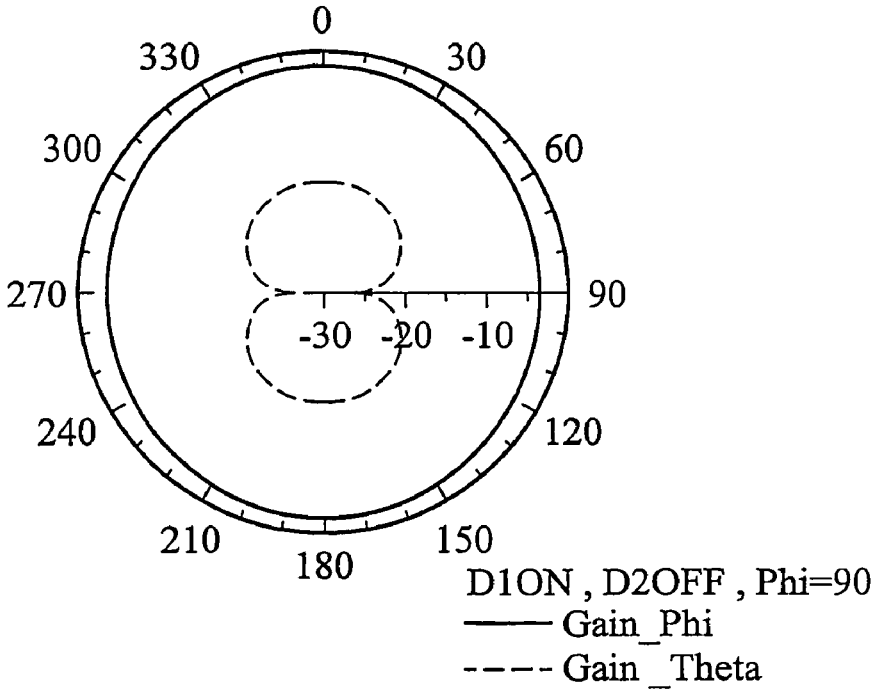
FIG. 5*d* shows the radiation pattern on the $\phi=90°$ tangent plane when the antenna of one embodiment of the invention in the second working mode.

Since the antenna of the embodiment of the invention has a first working mode and a second working mode to provide two different flowing directions of the induced currents, two different radiation patterns can be produced. When the signals received in one working mode are not preferred, users can switch to the other working mode to obtain a preferred wireless communication effect. Refer to FIG. 5*a* which is a polar diagram showing the radiation pattern on the $\phi=0°$ tangent plane when the antenna of the embodiment of the invention is in the first working mode. FIG. 5*b* is a polar diagram showing the radiation pattern on the $\phi=90°$ tangent plane. Refer to FIG. 5*c* which is a polar diagram showing the radiation pattern on the $\phi=0°$ tangent plane when the antenna of the embodiment of invention transmits wireless signals in the second working mode. FIG. 5*d* is a polar diagram showing the radiation pattern on the $\phi=90°$ tangent plane. As FIG. 5*a*, FIG. 5*b*, FIG. 5*c* and FIG. 5*d* have shown, the first working mode and the second working mode can be used and switched by the antenna of the embodiment of the invention, and radiation characteristics thereof are quite different, so that signals with different polarizing characteristics can be received and a preferred signal transmitting effect can be obtained.

Refer to FIG. 2. The first metal sheet 143 is approximately square, and the function thereof is equivalent to that of a capacitor. The width $w_1$ can depend on the following formula:

$$w_1 = \frac{1}{2\pi f}\sqrt{\frac{d}{\varepsilon_0 \varepsilon_r L_{d1}}}, \quad (1)$$

wherein f represents the working frequency of a wireless signals, d represents the depth of the base plate, $\epsilon_0$ represents the permittivity of air, $\epsilon_r$ represents the permittivity of the base plate, and $L_{d1}$ represents the equivalent pin inductance of first diode. The second metal sheet 153 is approximately square, and the width $w_2$ can depend on the following formula:

$$w_2 = \frac{1}{2\pi f}\sqrt{\frac{d}{\varepsilon_0 \varepsilon_r L_{d2}}}, \quad (2)$$

wherein f represents the working frequency of a wireless signal, d represents for the depth of the base plate, $\epsilon_r$ represents the permittivity of the base plate, and $L_{d2}$ represents the equivalent pin inductance of the second diode. The metal sheets 143 and 153 can be replaced by common capacitors. When the metal sheet 143 or 153 is replaced by a capacitor, the other end of the capacitor must be connected to the second part 122.

The length of the second conducting part 132 is about $\lambda/4$, wherein $\lambda$ represents the wavelength of the working frequency of a wireless signal in the notch guided wave structure.

In the embodiment, the distance from the first wire 141 to the first conducting part 131 is the same as the distance form the second wire 151 to the first conducting part 131. In this way, when the first working mode and the second working mode are switched and used, the frequency of the two working modes is the same, but the radiation patterns of the two working modes are different. However, in another embodiment, the distance from the first wire to the first conducting part can be different from the distance from the second wire to the first conducting part. In this way, two kinds of wireless signals with different frequency can be transmitted.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An antenna comprising:

a base plate comprising a first surface and a second surface;

a grounding component provided on the first surface, wherein the grounding component comprises:

a first part;

a second part, and a groove which is L-shaped and formed between the first part and the second part, wherein the groove comprises a first segment, a second segment and a corner, and the first segment is perpendicular to the second segment, and the corner is connected to the first segment and the second segment;

a feed-in conductor provided on the second surface, wherein the feed-in conductor comprises a first conducting part which extends across the corner, passes through the base plate, and is coupled to the first part;

a first controlling unit provided on the second surface, wherein the first controlling unit comprises a first wire which extends across the first segment, passes through the base plate, and is coupled to the first part; and a second controlling unit provided on the second surface, wherein the second controlling unit comprises a second wire which extends across the second segment, passes through the base, and is coupled to the first part.

2. The antenna according to claim 1, wherein the feed-in conductor further comprises a second conducting part which is perpendicular to the first conducting part, passes the base plate, and is coupled to the second part.

3. The antenna according to claim 2, wherein the length of the second conductor is about $\lambda/4$, and $\lambda$ represents the wavelength of a wireless signal.

4. The antenna according to claim 1, wherein when the antenna is in a first working mode, the first wire conducts, and when the antenna is in a second working mode, the second wire conducts.

5. The antenna according to claim 4, wherein the first controlling unit further comprises a first diode, a first metal sheet, a first transmitting wire and a first capacitor, and the first diode is coupled to the first wire and the first metal sheet, the first transmitting wire is coupled to the first metal sheet, and the first capacitor is coupled to the first transmitting wire and the second part.

6. The antenna according to claim 5, wherein an external voltage is applies on the first transmitting wire in the first transmitting mode.

7. The antenna according to claim 5, wherein the first metal sheet is equivalent to a grounded capacitor or can be replaced by a common capacitor.

8. The antenna according to claim 4, wherein the second controlling unit further comprises a second diode, a second metal sheet, a second transmitting wire and a second capacitor, and the second diode is coupled to the second wire and a second metal sheet, the second transmitting wire is coupled to the second metal sheet, and the second capacitor is coupled to the second transmitting wire and the second part.

9. The antenna according to claim 8, wherein an external voltage is applies on the second transmitting wire in a second transmitting mode.

10. The antenna according to claim 8, wherein the second metal sheet is equivalent to a grounded capacitor or can be replaced by a common capacitor.

11. The antenna according to claim 1, wherein the distance from the first wire to the first conducting part is the same as the distance from the second wire to the first conducting part.

12. The antenna according to claim 1, wherein the distance from the first wire to the first conducting part is not the same as the distance from the second wire to the first conducting part.

13. An antenna comprising:

a base plate comprising a first surface and a second surface;

a grounding component provided on the first surface, wherein the grounding component comprises:

a first part;

a second part; and a notch formed between the first part and the second part;

a feed-in conductor provided on the second surface, wherein the feed-in conductor comprises a first conducting part which extends across the notch, and is coupled to the first part;

a controlling unit provided on the second surface, wherein the controlling unit comprises a first wire which extends across the notch, and is coupled to the first part; and a second controlling unit provided on the second surface, wherein the second controlling unit comprises a second wire which extends across the notch, and is coupled to the first part.

14. The antenna according to claim 13, wherein the feed-in conductor further comprises a second conducting part which is perpendicular to the first conducting part, passes through the base plate, and is coupled to the second part.

15. The antenna according to claim 14, wherein the length of the second conducting part is about $\lambda/4$, and $\lambda$ represents the wavelength of a wireless signal.

16. The antenna according to claim 13, where when the antenna is in a first working mode, the first wire conducts, and when the antenna is in a second working mode, the second wire conducts.

17. The antenna according to claim 16, wherein the first controlling unit further comprises a first diode, a first metal sheet, a first transmitting wire and a first capacitor, and the first diode is coupled to the first wire and the first metal sheet, the first transmitting wire is coupled to the first metal sheet, and the first capacitor is coupled to the first transmitting wire and the second part.

18. The antenna according to claim 17, wherein an external voltage is applied on the first transmitting wire in a first transmitting mode.

19. The antenna according to claim 17, wherein the first metal sheet is equivalent to a grounded capacitor or can be replaced by a common capacitor.

20. The antenna according to claim 16, wherein the second controlling unit further comprises a second diode, a second metal sheet, a second transmitting wire and a second capacitor, and the second diode is coupled to the second wire and the second metal sheet, the second transmitting wire is coupled to the second metal sheet, and the second capacitor is coupled to the second transmitting wire and the second part.

21. The antenna according to claim 20, wherein an external voltage is applied on the second transmitting wire in a second transmitting mode.

22. The antenna according to claim 20, wherein the second metal sheet is equivalent to a grounded capacitor or can be replaced by a common capacitor.

23. The antenna according to claim 13, wherein the distance from the first wire to the first conducting part is the same as the distance from the second wire to the first conducting part.

24. The antenna according to claim 13, wherein the distance from the first wire to the first conducting part is not the same as the distance from the second wire to the first conducting part.

* * * * *